US007223926B1

(12) United States Patent
Gannon et al.

(10) Patent No.: US 7,223,926 B1
(45) Date of Patent: May 29, 2007

(54) KNOB ASSEMBLY FOR OPERATING THE SWITCH OF A RADIO

(75) Inventors: Joshua Storm Gannon, Fairport, NY (US); Amy Gontarek, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/457,166

(22) Filed: Jul. 13, 2006

(51) Int. Cl.
*H01H 9/30* (2006.01)

(52) U.S. Cl. ..... 200/11 R; 200/564; 200/566

(58) Field of Classification Search ..... 200/11 R, 200/11 TW, 11 TC, 14, 564–566, 567, 293, 200/336
See application file for complete search history.

(56) References Cited

U.S. PATENT DOCUMENTS 4,243,853 A * 1/1981 Turner ..... 200/8 R
4,246,453 A * 1/1981 Marchese et al. ..... 200/11 R
4,716,263 A * 12/1987 Havel ..... 200/11 R
5,180,050 A * 1/1993 Rada et al. ..... 200/329
5,194,704 A * 3/1993 Michalski et al. ..... 200/11 R
5,990,426 A * 11/1999 Amonett ..... 200/38 R
6,423,912 B1 * 7/2002 Arenz et al. ..... 200/43.08
6,613,997 B2 * 9/2003 Oster et al. ..... 200/564

* cited by examiner

*Primary Examiner*—K. Lee
(74) *Attorney, Agent, or Firm*—Gary Robinson, P.A.

(57) ABSTRACT

A knob assembly for the switch of a radio is provided which prevents the switch from being rotated to certain positions except when the knob is moved in an axial direction after contact with a stop. The knob may be returned to a location where other switch positions may be selected without requiring further axial motion of the knob on the part of the radio operator.

12 Claims, 4 Drawing Sheets

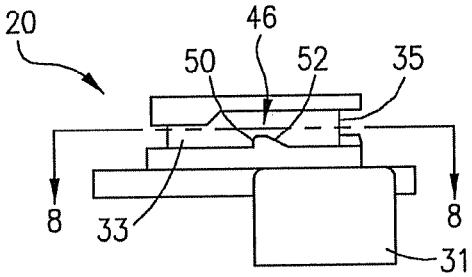
FIG. 8
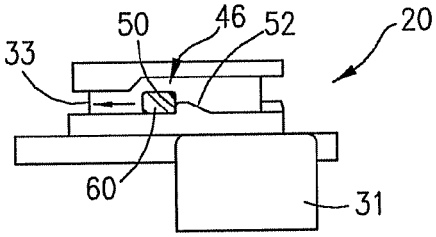
FIG. 9
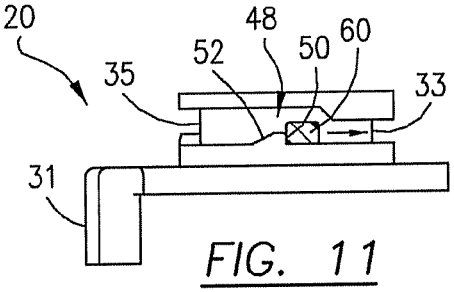
FIG. 11
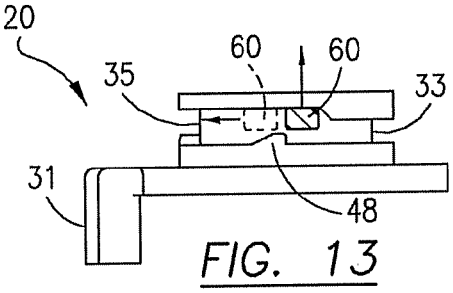
FIG. 13
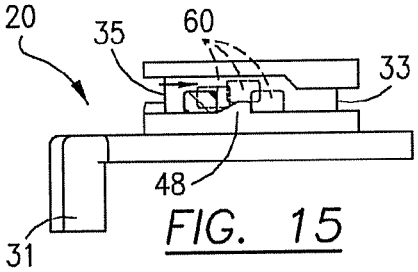
FIG. 15
FIG. 10
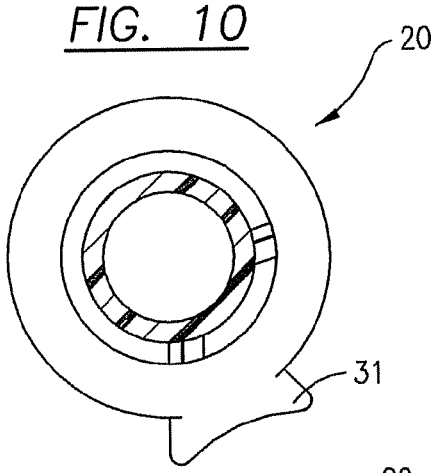
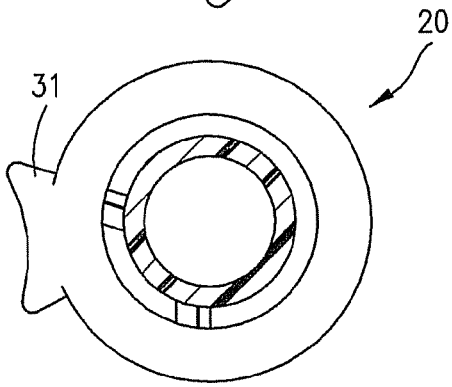
FIG. 12
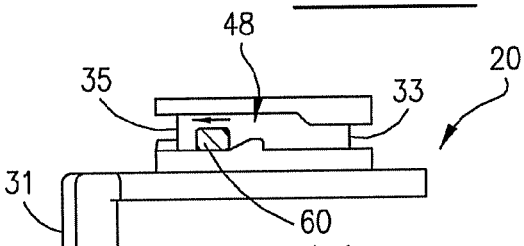
FIG. 14

KNOB ASSEMBLY FOR OPERATING THE SWITCH OF A RADIO

FIELD OF THE INVENTION

This invention relates to radios, and, more particularly, to an improved knob assembly for operating the switch of the radio to prevent inadvertent movement of the switch to the "off" and "Z-all" positions.

BACKGROUND OF THE INVENTION

Satellite radios include a switch which is movable to a number of positions, typically, "off," "channels 1–5" (or more), "scan," "front panel," which allows the channels and modes of operation to be selected using the key pad on the front panel of the radio, and, "Z-all." The Z-all position refers to zero-all which clears the encryption cipher keys in the radio. When switching channels, current switch designs allow the radio to be inadvertently turned off. The radio must then reboot, essentially cutting off communication for the duration of the reboot.

The switches presently employed with satellite radios also permit inadvertent movement to the Z-all position. Although the radio is protected while in the Z-all position by requiring actuation of the volume up button, it is desirable to prevent inadvertent movement to the Z-all position directly. There is a need for an improved device for controlling the operation of the switch of satellite radios to protect against inadvertent switch movement.

SUMMARY OF THE INVENTION

This invention is directed to a knob assembly for the switch of a radio, and particularly a satellite radio, which prevents the switch from being rotated to the off and Z-all positions except when the knob is moved in an axial direction after contact with a stop. The knob may then be returned to a location where other switch positions may be selected, without requiring further axial motion of the knob on the part of the radio operator.

The knob assembly comprises an outer knob, coupled to the stem of the radio switch, and a position control element held in a fixed position relative to the switch. The position control element is formed with a circumferentially extending track within which a pin formed on the outer knob is movable to position the switch so that a particular channel or mode of operation may be selected. If an attempt is made to rotate the knob to the off or Z-all positions, the pin in the outer knob engages one of two stops located within the channel of the position control element. The outer knob must then be pulled in an axial direction to clear the stop before it can be rotated to the off or Z-all positions. Preferably, each stop has a beveled surface which faces the pin of the outer knob when it is in position to select the off or Z-all positions. The pin rides up along a beveled surface when the outer knob is rotated from such positions, thus allowing the pin to clear the stops without requiring the operator to pull the outer knob in an axial direction.

BRIEF DESCRIPTION OF THE DRAWINGS

The structure, operation and advantages of the presently preferred embodiment of this invention will become further apparent upon consideration of the following description, taken in conjunction with the accompanying drawings, wherein:

FIG. 8 is a side view of the position control element;

FIG. 9 is a side view of the position control element with the pin of the outer knob illustrated in contact with one of the stops located in the track of the position control element;

FIG. 10 is a plan view, in partial cross section, depicting the position of the outer knob with its pin as shown in FIG. 9;

FIG. 11 is a side view of the position control element with the pin of the outer knob illustrated in contact with the other of the stops located in the track of the position control element;

FIG. 12 is a plan view, in partial cross section, depicting the position of the outer knob with its pin as shown in FIG. 11; and FIGS. 13–15 are side views of the position control element depicting how the pin of the outer knob moves axially to clear the stops in the track of the position control element.

DETAILED DESCRIPTION OF THE INVENTION

Figure 1:
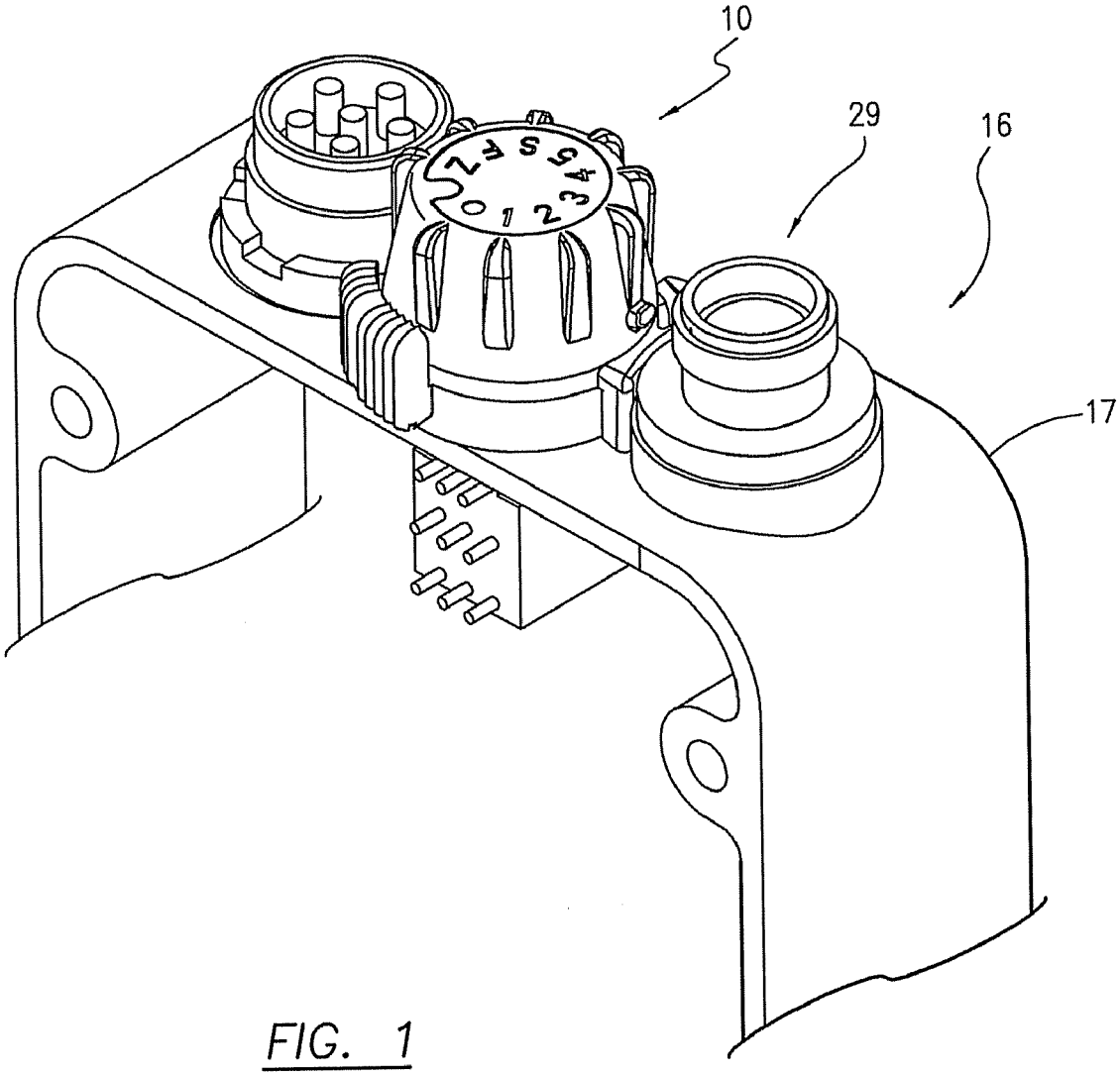
FIG. 1 is a perspective view of the knob assembly of this invention coupled to the switch of a satellite radio, the housing of which is partially shown.
Figure 2:
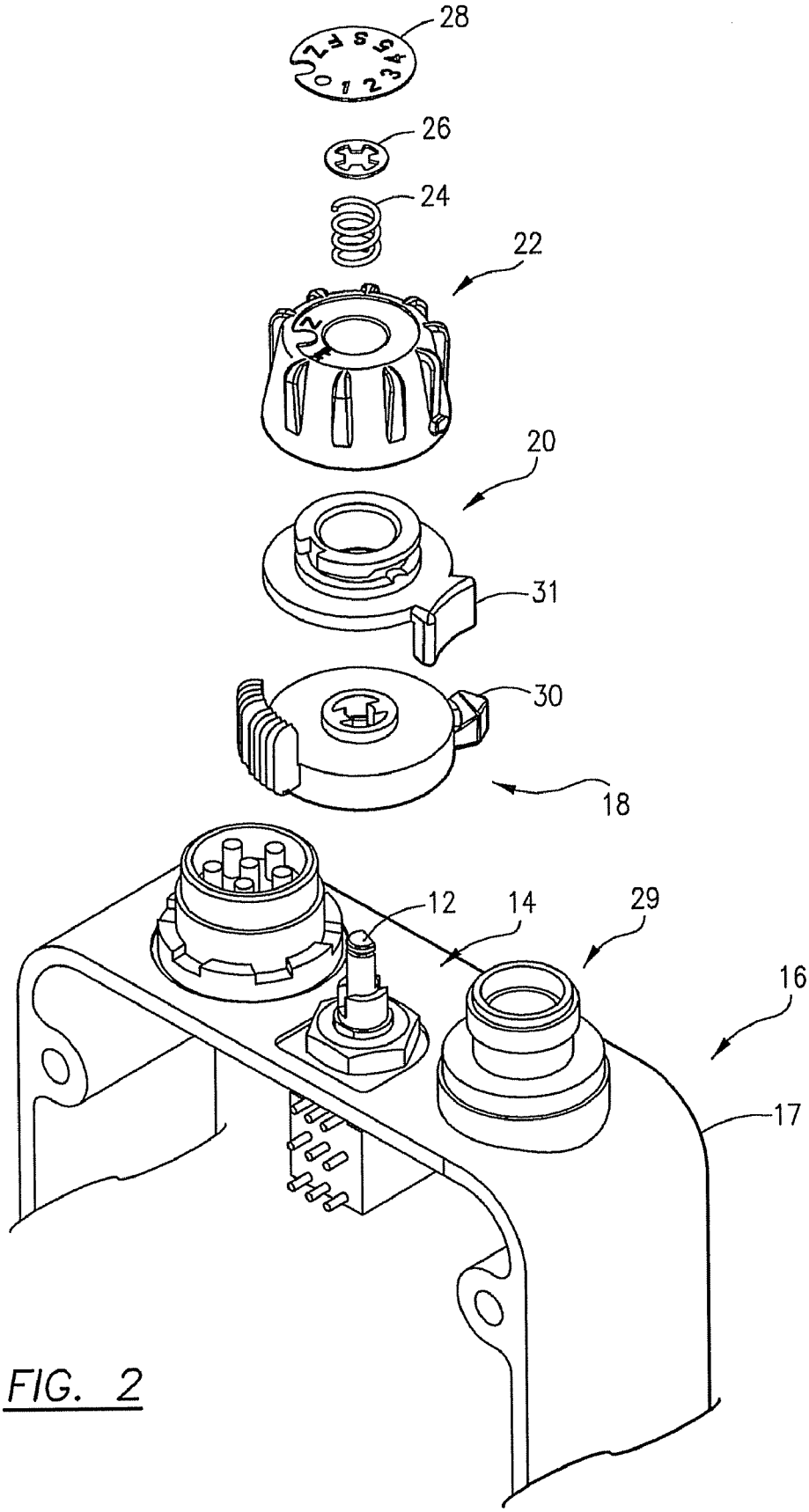
FIG. 2 is an exploded view of the knob assembly, including the switch and a portion of the housing of the radio depicted in FIG. 1.
Figure 3:
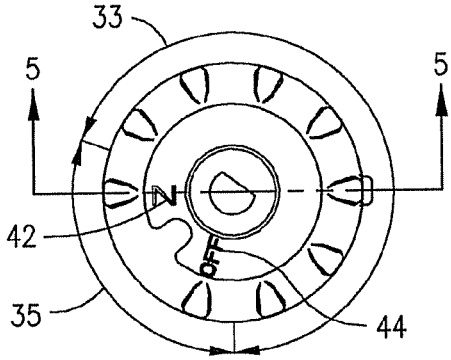
FIG. 3 is a plan view of the outer knob of the knob assembly, showing the switch positions.
Figure 4:
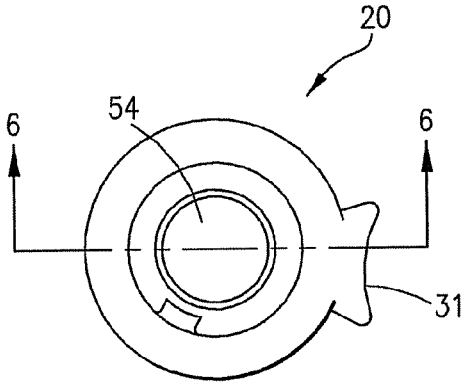
FIG. 4 is a plan view of the position control element of the knob assembly.
Figure 5:
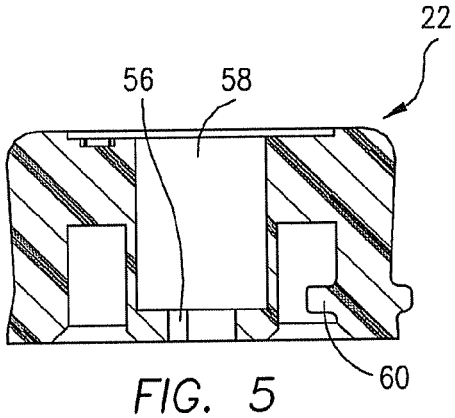
FIG. 5 is a cross sectional view of the outer knob, taken generally along line 5—5 of FIG. 3.
Figure 6:
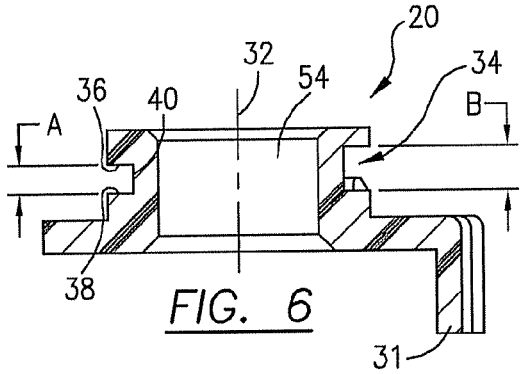
FIG. 6 is a cross sectional view of the position control element, taken generally along line 6—6 of FIG. 4.

Referring initially to FIGS. 1 and 2, the knob assembly 10 of this invention is intended to control the rotation of the stem 12 of a switch 14 used in a satellite or other type of radio 16, and prevent inadvertent movement of the switch 14 to the off or Z-all positions. Only a portion of the chassis 17 of the radio 16 is shown in the Figs. for ease of illustration. The knob assembly 10 comprises and inner knob 18, a position control element 20, an outer knob 22, a compression spring 24, a retention clip 26 and a switch position label 28. The inner knob 18 is coupled to the switch 14 and may be rotated to selected positions to place the radio in different modes of operation, e.g. plain text, cipher text or load mode, for example, when used with a satellite radio. Inner knob 18 is formed with a projection 30 which acts as a position indicator to denote which mode of operation of the radio 16 is active. A flange 31 extends from the position control element 20 and into contact with a projection 29 from the chassis 17 of the radio 16. The position control element 20 is seated on the inner knob 18 and held in a fixed position relative to switch 14 by engagement of its flange 31 with the projection 29.

The position control element 20 and outer knob 22 are the key elements of the knob assembly 10 which control rotation of the stem 12 of switch 14. As best seen in FIGS. 3–7, the position control element 20 has a longitudinal axis 32 and is formed with a circumferentially extending track 34 defining a top wall 36, a bottom wall 38 and a side wall 40 extending between the top and bottom walls 36, 38. For purposes of the present discussion, the terms "top," "bottom," "up," "upwardly," "down" and "downwardly" refer to vertical locations or directions with the components of the knob assembly 10 oriented as shown in the Figs. The track 34 has a height dimension which is measured in a direction parallel to the longitudinal axis 32 and extending between its top and bottom wall 36, 38. A section 33 of the track 34 has a height dimension "A," noted in FIG. 6, which extends from a location near the Z-all position 42 in a clockwise direction to the a location near the off position 44, as viewed in FIG. 3. The remainder of the track 34, which encompasses only the Z-all position 42 and off position 44 and is identified as section 35 in FIG. 3, has a height dimension "B." The height dimension B is greater than that of A, for purposes described below.

As shown in FIGS. 8–15 and described in more detail below, a first stop 46 and a second stop 48 are located within the track 34 of the position control element 20 and are circumferentially spaced from one another. The stop 46 is located near the Z-all position 42, and the stop 48 is located near the off position 44. Each stop 46, 48 has a vertical surface 50 and a beveled surface 52. The beveled surface 52 of stop 46 faces the beveled surface 52 of stop 48.

The stem 12 of switch 14 extends through a bore 54 in the position control element 20 and into engagement with a slot 56 at the base of the outer knob 22. A bore 58 in the outer knob 22 receives the spring 24, which encircles the switch stem 12. The clip 26 retains the spring 24 in position within the outer knob 22 so that it bears against and urges the outer knob 22 toward the position control element 20. The outer knob 22 is formed with a pin 60, which, when the outer knob 22 and position control element 20 are coupled to one another, extends within the track 34 of the position control element 20.

Figure 7:
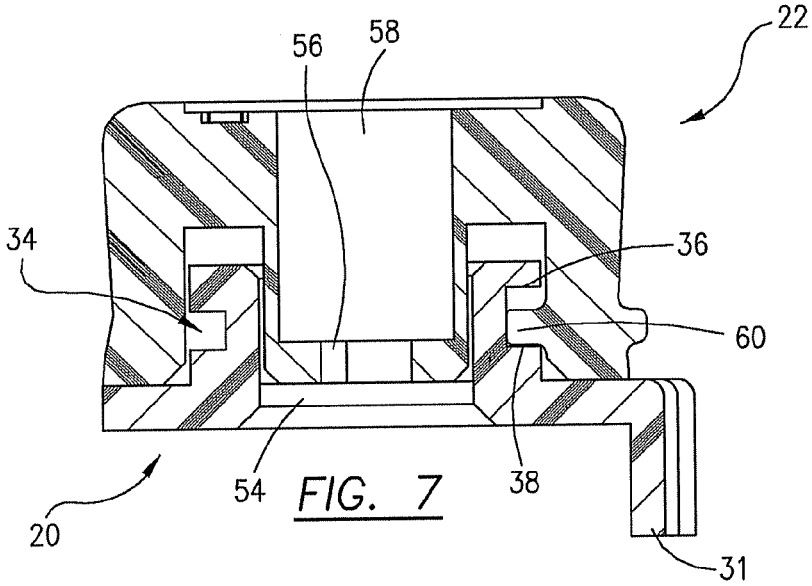
FIG. 7 is an assembled, cross sectional view of the outer knob and position control element.

Referring now to FIGS. 3–15, the operation of the knob assembly 10 is discussed. As best seen in FIG. 7, the pin 60 of the outer knob 22 is urged by the spring 24 into a first axial position, i.e., into engagement with the bottom wall 38 of the track 34 in the position control assembly 20. The pin 60 slides along the bottom wall 38 as the outer knob 22 is rotated within section 33 of the track 34, which, in turn, moves the switch 14 to selected positions. With the pin 60 located within section 33 of the track 34, the switch 14 can select each of the channels and all other modes of operation of the radio 10 with the exception of the Z-all position 42 and the off position 44. When the operator rotates the outer knob 22 toward the Z-all position 42, its pin 60 contacts the vertical surface 50 of the first stop 46 and prevents further movement of the switch 14 before the Z-all position 42 is reached. See FIGS. 9 and 10. Similarly, rotation of the outer knob 22 in the opposite direction toward the off position 44 eventually results in contact between the pin 60 and the vertical surface 50 of the second stop 48. See FIGS. 11 and 12. Consequently, engagement of the pin 60 with stops 46 and 48 prevents inadvertent advancement of the switch 14 into the section 35 of the track 34 where the Z-all and off positions 42, 44 are located.

In order to place the switch 14 in either the Z-all position 42 or the off position 44, the radio operator must grasp the outer knob 22 and pull it in an axial direction, e.g., to a second axial position away from the position control element 20, thus overcoming the spring force exerted by spring 24 acting in the opposite direction. The pin 60 of the outer knob 22, in turn, is lifted from the bottom wall 38 of the track 34 in a direction toward its top wall 36. The height "B" of the track 34 in the area of section 35 is sufficient to allow the pin 60 to clear either one of the stops 46 or 48. See FIGS. 6 and 13. Rotation of the outer knob 22 when in this second, axial position allows the pin 60 to pass over the stops 46 or 48 and enter the section 35 of track 34 where the switch 14 may be moved to either the Z-all or off positions 42, 44, as desired. See FIG. 14. The outer knob 22 may be returned to section 33 of the track 34 by merely rotating it in the desired direction. The pin 60 engages the beveled surface 52 of one of the stops 46 or 48, and rides up along such surface 52 until it clears the stop 46 or 48 and enters section 33 of track 34. See FIG. 15. There is no need to pull axially on the outer knob 22 to exit section 35 of the track 34.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Apparatus for operating the switch of a radio, comprising:

a position control element which is fixed relative to the rotating stem of the switch of a radio, said position control element having a longitudinal axis and being formed with a circumferentially extending track, said track having a height dimension measured in an axial direction generally parallel to said longitudinal axis, a first section of said track having a first height dimension and a second section of said track having a second height dimension which is greater than said first height dimension;

a first stop and a second stop each located within said second section of said track and being circumferentially spaced from one another;

a knob adapted to be coupled to the stem of the switch, said knob being rotatable relative to said position control element in a circumferential direction and being movable in an axial direction between a first axial position and a second axial position, said knob having a pin which is movable along said first section of said track with said knob in said first axial position, said knob being prevented from movement into said second section of said track by contact of said pin with either of said first and second stops while said knob is in said first axial position, said pin avoiding contact with said first or second stop upon movement of said knob to said second axial position thus allowing said knob to rotate into said second section of said track, whereby said knob is adapted to move said switch to selected positions with said pin located within said first section of said track and to other selected positions with said pin located within said second section of said track.

2. The apparatus of claim 1 in which each of said first and second stops is formed with a beveled edge, each of said beveled edges being effective to contact said pin of said knob while said knob is rotated within said second section of said track to cause said knob to move from said first axial position to said second axial position.

3. The apparatus of claim 1 further including a biasing element coupled to said knob, said biasing element being effective to urge said knob into said first axial position.

4. The apparatus of claim 1 in which one of said first and second stops prevents said knob from moving the switch to an off position without first moving said knob to said second axial position.

5. The apparatus of claim 4 in which the other of said first and second stops prevents said knob from moving the switch to a zero-all position without first moving said knob to said second axial position.

6. The apparatus of claim 1 further including a second knob adapted to mount to a radio and couple to its switch, said position control element being mounted in a fixed position relative to said second knob.

7. The apparatus of claim 1 in which said second height dimension of said track is sufficient to allow said pin to clear each of said first and second stops.

8. Apparatus for operating the switch of a radio, comprising:

an inner knob adapted to mount to a radio and couple to its switch, said inner knob being effective to switch the radio to different operating modes;

a position control element mounted in a fixed position relative to said inner knob, said position control element having a longitudinal axis and being formed with a circumferentially extending track, said track having a height dimension measured in an axial direction generally parallel to said longitudinal axis, a first section of said track having a first height dimension and a second section of said track having a second height dimension which is greater than said first height dimension;

a first stop and a second stop each located within said second section of said track and being circumferentially spaced from one another;

an outer knob adapted to be coupled to the stem of the switch, said outer knob being rotatable relative to said position control element in a circumferential direction and being movable in an axial direction between a first axial position and a second axial position, said outer knob having a pin which is movable along said first section of said track with said outer knob in said first axial position, said outer knob being prevented from movement into said second section of said track by contact of said pin with either of said first and second stops while said outer knob is in said first axial position, said pin avoiding contact with said first or second stop upon movement of said outer knob to said second axial position thus allowing said outer knob to rotate into said second section of said track, whereby said outer knob is adapted to move said switch to selected positions with said pin located within said first section of said track and to other selected positions with said pin located within said second section of said track;

a biasing element coupled to said outer knob, said biasing element urging said outer knob into said first axial position.

9. The apparatus of claim 8 in which each of said first and second stops is formed with a beveled edge, each of said beveled edges being effective to contact said pin of said knob while said knob is rotated within said second section of said track to cause said outer knob to move from said first axial position to said second axial position.

10. The apparatus of claim 8 in which one of said first and second stops prevents said outer knob from moving the switch to an off position without first moving said outer knob to said second axial position.

11. The apparatus of claim 10 in which the other of said first and second stops prevents said outer knob from moving the switch to a zero-all position without first moving said outer knob to said second axial position.

12. The apparatus of claim 8 in which said second height dimension of said track is sufficient to allow said pin to clear each of said first and second stops.

* * * * *